US008253345B2

(12) United States Patent
Shen

(10) Patent No.: US 8,253,345 B2
(45) Date of Patent: Aug. 28, 2012

(54) METHOD FOR DRIVING LED

(76) Inventor: Yu-Nung Shen, Taipei (TW)

( * ) Notice: Subject to any disclaimer, the term of this patent is extended or adjusted under 35 U.S.C. 154(b) by 798 days.

(21) Appl. No.: 12/172,524

(22) Filed: Jul. 14, 2008

(65) Prior Publication Data

US 2009/0015170 A1 Jan. 15, 2009

Related U.S. Application Data

(63) Continuation-in-part of application No. 11/776,697, filed on Jul. 12, 2007, now abandoned.

(51) Int. Cl.
*H05B 41/36* (2006.01)

(52) U.S. Cl. ..... 315/291; 315/302

(58) Field of Classification Search ..... 315/291, 315/302, 300, 307, 7

See application file for complete search history.

(56) References Cited

U.S. PATENT DOCUMENTS

| | | | | |
|---|---|---|---|---|
| 6,028,694 | A | 2/2000 | Schmidt | |
| 2003/0076057 | A1* | 4/2003 | Fleury | 315/291 |
| 2005/0237005 | A1* | 10/2005 | Maxik | 315/247 |
| 2006/0187181 | A1* | 8/2006 | Kim | 345/102 |

* cited by examiner

*Primary Examiner* — Douglas W Owens
*Assistant Examiner* — Jianzi Chen
(74) *Attorney, Agent, or Firm* — Houston & Associates, LLP

(57) ABSTRACT

A method for driving a LED and to an illumination system comprising at least one LED. The LED is driven by a pulse signal, wherein the pulse signal comprises pulses of a duration of T/n, wherein T is the duration of a single pulse and the corresponding pause in between two consecutive pulses and n is at least 2, and the current value of the pulses is at least double as much as the nominal constant current of said LED. The light intensity is increased by n times while the power consumption is the same in comparison to driving that LED with a prescribed constant driving voltage and the prescribed constant driving current.

20 Claims, 14 Drawing Sheets duration during which the insulating material coated on a LED releases stored photo energy > pulse cycle time > 100 nsec.

METHOD FOR DRIVING LED

RELATED APPLICATIONS

This application is a Continuation-in-Part of U.S. application Ser. No. 11/776,697, filed on Jul. 12, 2007, which is incorporated herein by reference in its entirety.

BACKGROUND OF THE INVENTION

Recently, the tendency of using Light-Emitting Diodes (LEDs) as light source for electronic devices, lighting devices, etc. is continuously increasing. However, in order to completely replace with LEDs the traditional light sources, especially the indoor lighting devices, the intensity of the light emitted by the LEDs must be greatly enhanced.

There are LEDs with different nominal power. The nominal power is the electric power with which the LEDs shall be driven. The nominal power is limited. If a LED is driven with an electric power larger than the nominal power the increase in brightness is lower than below the nominal power. This effect is well known and to minimize this effect it is known to actively cool the LEDs. However, an active cooling is very laborious and in most applications of LEDs it is not possible to provide a suitable cooling mechanism. If the breakdown state is achieved the brightness can not be further increased even if a higher electric power is applied. The breakdown state is usually achieved with a current of more than about 40% to 50% of the nominal constant current. For example, if the nominal constant current is about 350 mA then the breakdowns state is achieved by about 500 mA.

The standard LEDs have a nominal power of about 1.2 W. There are also known high power LEDs with a nominal power of about 3 W or 5 W. A nominal constant current corresponds to a nominal power as the LEDs are always driven with a voltage of 3.5 V. So the nominal power is the nominal constant current multiplied with 3.5 V.

U.S. Pat. No. 6,028,694 discloses an illumination device using a pulse modulation technique for providing an increased light output for a given heat load. This illumination device is designed for being used in surgery applications. The power is supplied in pulses to periodically activate a short wavelength emitting LED. These light pulses are stimulating a phosphor-based color conversion system to produce white light. The light pulse from the LED briefly excites the phosphor system, producing a bright illumination during the interval while power is dissipated in the LED, the LED warms. After the pulse ends and before the next pulse begins, the LED cools because no more power is dissipated in the LED. The intensity of the illumination produced by the phosphor gradually decays between the light pulses. However, the average illumination produced over the entire period is higher than a conventional LED illumination device using constant power dissipation for a given heat load. As this device is designed to be used in a human body it is only driven with a low electric power, because otherwise the human body would be injured due to the created heat.

SUMMARY OF THE INVENTION

The present invention relates to a method for driving a LED, and more particularly, to a method for driving a LED which can effectively enhance the light intensity of a LED.

The present invention provides a method for driving a LED which can enhance the light intensity of a LED.

One aspect of the present invention is a method for driving a LED by a pulse signal, wherein the pulse signal comprises pulses of a duration of T/n, wherein T is the duration of a single pulse and the corresponding pause in between two consecutive pulses and n is at least 2, and the current value of the pulses is at least double as much as the nominal constant current of said LED.

It was surprisingly found that using pulse signals with such a high current value which is significantly larger than the constant current at the breakdown state does not harm the LED. Even more astonishing is that such high currents are very efficiently converted into electric light. This allows the application of a high electric power to a LED wherein the electric power is very efficiently converted into light.

A further aspect of the present invention is to drive a LED by a pulse signal, wherein an electric power of at least 90% of the nominal power of said LED is applied to the LED.

Applying the same amount of electric power by means of constant current would result in a significantly lower brightness. This high yield of brightness is achieved without active cooling. Thus the maximum brightness or luminance of an LED can be significantly increased. With the present invention a high electric power can be applied to a LED without an increased effectiveness of the conversion of electric power to electric light. Due to the pulse signal the impact of the breakdown state is shifted to higher electric power.

Preferably the LED is driven with an electric power of at least 80%, or at least 100% or even more preferably 110% of the nominal power for applying constant current.

The pulse signal can comprise pulses of a duration of T/n, wherein T is the duration of the pulse and the pause in between two consecutive pulses and the current of each pulse is at least n times the nominal constant current of said LED. Preferably n is at least 3, or at least 4 or larger.

The light efficiency can be further increased if the LED is cooled. The cooling can be carried out by means of a passive cooling block (e.g. block of aluminum with cooling ribs) or by means of an active cooling element (e.g. peltier element, fan).

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
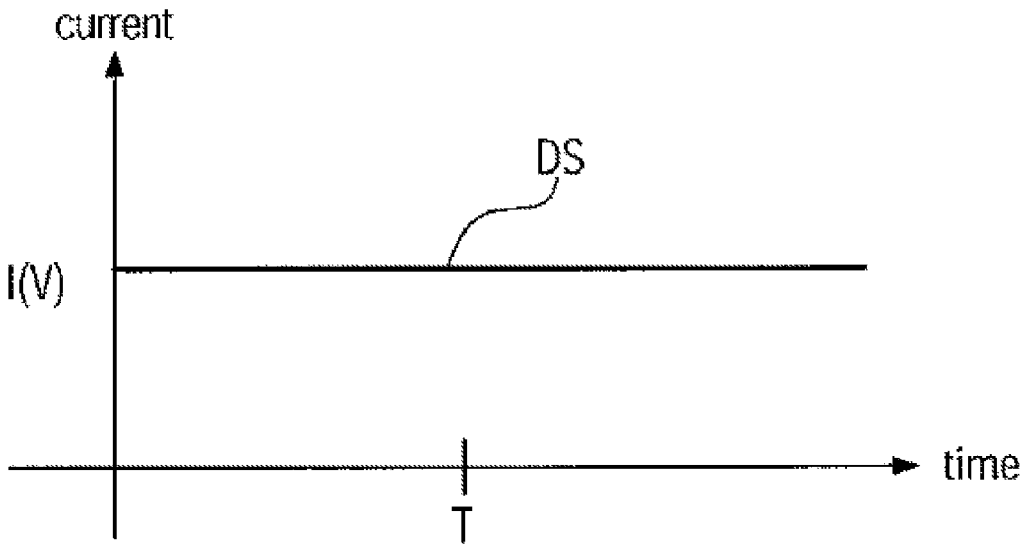
FIG. 1 Prior Art
FIG. 1 is a plot of current/voltage as a function of time showing a waveform of a conventional driving current signal for a light-emitting diode (LED)

In the drawings, like numerals are used for like elements throughout.

An embodiment of the present invention will now be discussed with reference to the drawings.

Figure 2:
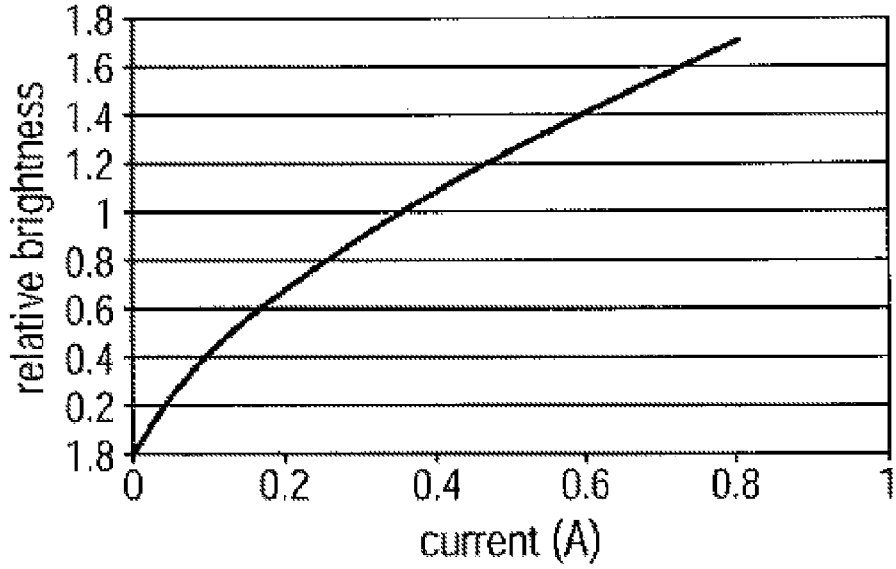
FIG. 2 Prior Art
FIG. 2 is a plot of relative brightness as a function of current showing the relationship between the brightness of a LED and the magnitude of driving current.

FIG. 1 shows a waveform of a conventional driving current signal DS for a light-emitting diode (LED) which is operated at a prescribed constant driving voltage of V and a prescribed constant driving current of 1 such that the prescribed power consumption P of the LED in a prescribed unit of time T is V×1. For a LED which is operated at a prescribed constant driving current of 350 milliAmperes (mA) and a prescribed constant driving voltage of 1 V to emit light with an intensity of 30 illuminance (1×), as the current value of the driving current signal DS is increased, the light intensity increases accordingly, based on the relationship between the current value of the driving current signal and the light intensity shown in FIG. 2. For example, if the current value of the driving current signal DS is doubled to 700 mA (=350 mA×2), the light intensity will approximately increase to 601×. However, the power consumption P of the LED in a unit of time T will also be doubled, that is 2 Watts (W) (=3.5V×700 mA). It should be appreciated that the LED having the characteristics shown in FIG. 2 is available in the market.

Figure 3:
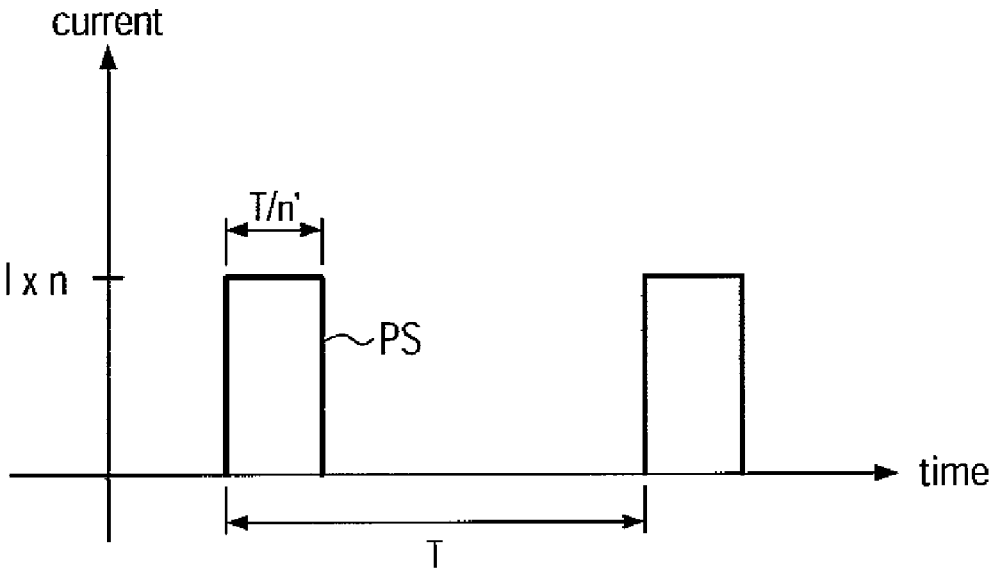
FIG. 3 is a plot of current as a function of time showing a waveform of a driving pulse signal used in a method of driving a LED according to the present invention.

Referring to FIG. 3, a driving pulse signal PS used in the method of the present invention is shown. It can be seen from FIG. 2, the light intensity will increase as the current value of the driving current signal is increased. Therefore, in the method of the present invention, a driving pulse signal PS, the cycle of which is equal to the prescribed unit of time T, is provided to the LED. The peak value of each of the pulse signals PS is n times the current value of the signal DS, and the high voltage level duration of the pulse signal PS is (T/n'), wherein n and n' are both positive integer excluding 0 and 1, and (n/n')≦1. Therefore, during the high voltage level duration (T/n'), the power consumption of the LED is increased by n times because the current value of the driving pulse signal PS at its high voltage level is n times the current value of the signal DS, thereby increasing the light intensity n times. However, the total power consumption of the LED in the unit of time T is still equal to P (=V×(I×n)×1/n'), therefore, the total power consumption is kept unchanged.

Figure 4:
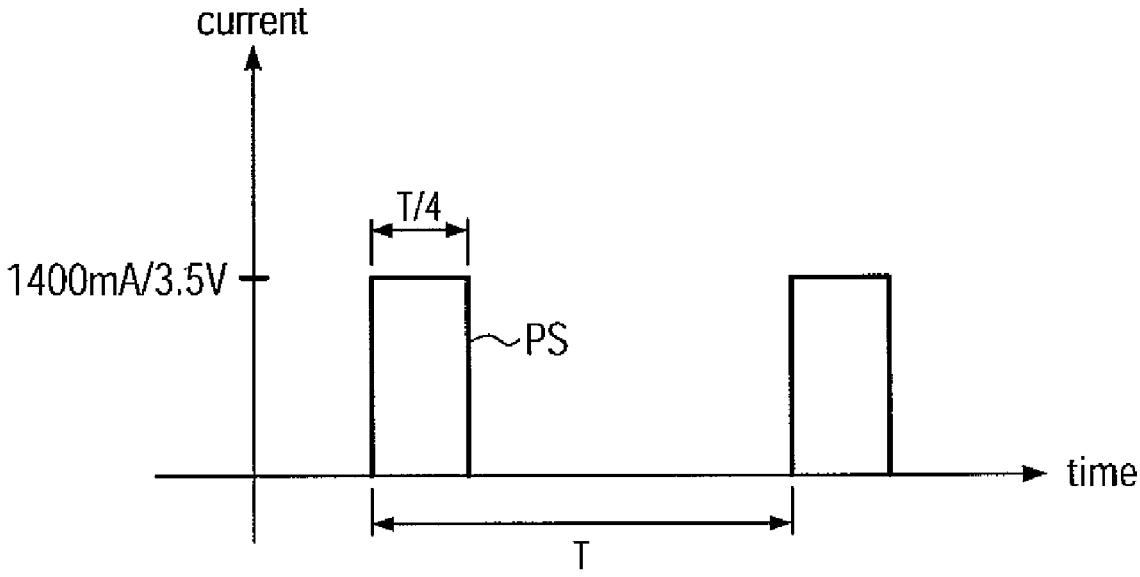
FIG. 4 is a plot of current as a function of time showing an exemplary example of a waveform of a driving pulse signal used in the method of driving a LED according to the present invention.

Referring to FIG. 4, if n is equal to 4, the current value of the current is 350 mA, the light intensity in the high voltage level duration T/n' increases 4 times. However, the total power consumption is still 1 W. Therefore, the total power consumption is unchanged while the light intensity increases n times.

Figure 9:
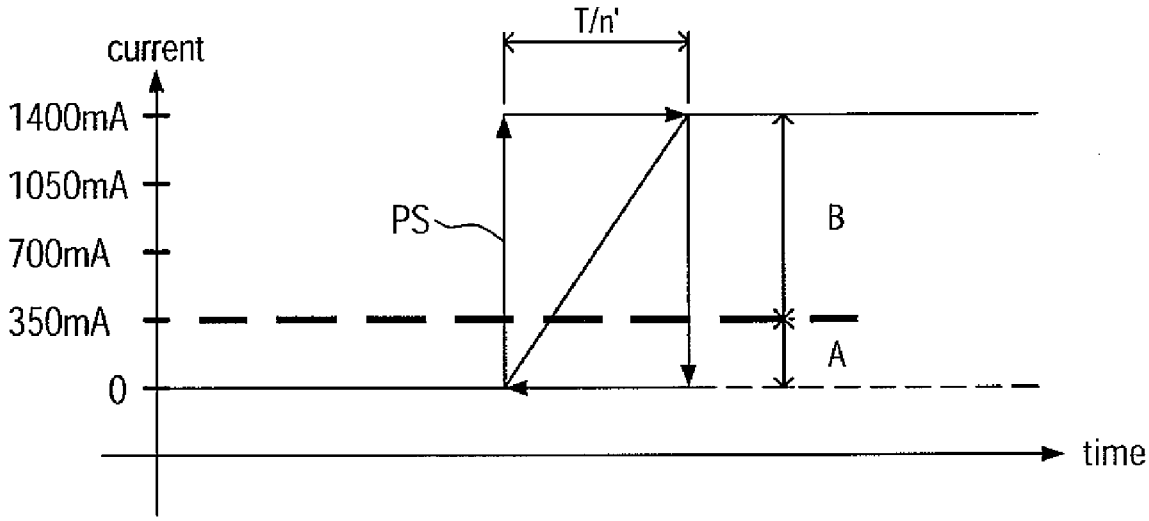
FIG. 9 is a schematic plot of current as a function of time for explaining the principle of the method according to the present invention.

It should be noted that, although the light intensity will increase as the current value of the driving current signal is increased, however, the number of times is not unlimited. As shown in FIG. 9, when the magnitude of the current is increased to some extent, the LED enters to the breakdown state. At this time, the light intensity will not increase anymore, even though the magnitude of the current is continuously increasing. It is noted that the current value for the breakdown state is at a higher level for a pulse signal than for a constant current. The selection of n is in relation to the high voltage level duration (T/n'), and the selection of the high voltage level duration (T/n') is based on the effective slope of the current of the LED. In FIG. 9, as indicated by the thick broken lines, it is known that the LED is driven by a constant current value of 350 mA, only a portion (A) of the effective slope of the current is used. However, the whole effective slope (A+B) will be used in the present invention. Therefore, the intensity of the light emitted from the LED driven by the method of the present invention is substantially increased.

It should be noted that, the magnitude of the current in FIG. 9 is by way of example, the present invention is not limited thereto. On the other hand, the arrow indicates the loop formed by the rising edge, the high voltage level duration, and the falling edge of the pulse, that is, the conditions based thereupon the peak value of the pulse and the high voltage level duration is selected.

Figure 19:
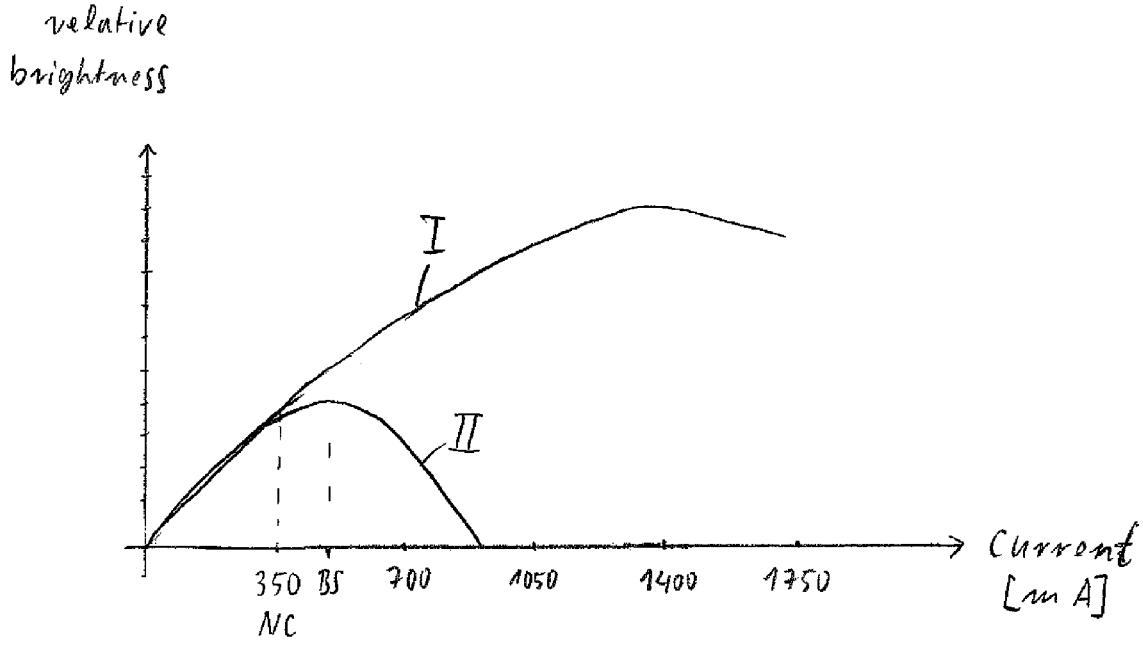
FIG. 19 is a diagram showing the relationship between the brightness and the current for driving a LED with constant current and with a pulse signal.

By using a pulse signal it is possible to drive the LEDs with a higher current than using a constant current. FIG. 19 shows schematically the effect of driving a LED with constant current (graph II) and with a pulse signal (graph I; T/3). When driving the LED with constant current the breakdown state limits the maximum current until which the light output can be increased. A LED having a nominal constant current of 350 mA (NC) has a maximum current of about 500 mA. This maximum current is called breakdown state current (BS). When the LED is driven with a pulse signal (graph I) it is possible to apply a much higher current without an effect of the breakdown state. Thus it is possible to reach a much higher brightness. FIG. 19 shows an example where n=3, which means that the duration of the pulses is T/3 and the duration of the pauses between two consecutive pulses is 2 T/3. The breakdown state current is about 1400 mA for a pulse width modulation with n=3 for a LED having a constant breakdown current of about 500 mA.

There are known high power LEDs having a nominal constant current of e.g. 700 mA for constant current by a voltage of 3.5 V. Those LEDs can be applied with a still higher current and electric power than the LED of the example according to FIG. 19.

With the present invention a very high brightness is achieved using a pulse signal and applying an electric power of at least 80% or at least or at least 90% of the nominal electric power. Particularly the electric power can be at least 100%, or 110%, or 120% or 130% of the nominal power. If an electric power of more than 100% of the nominal power it is advisable to provide a passive or an active cooling means.

Figure 10:
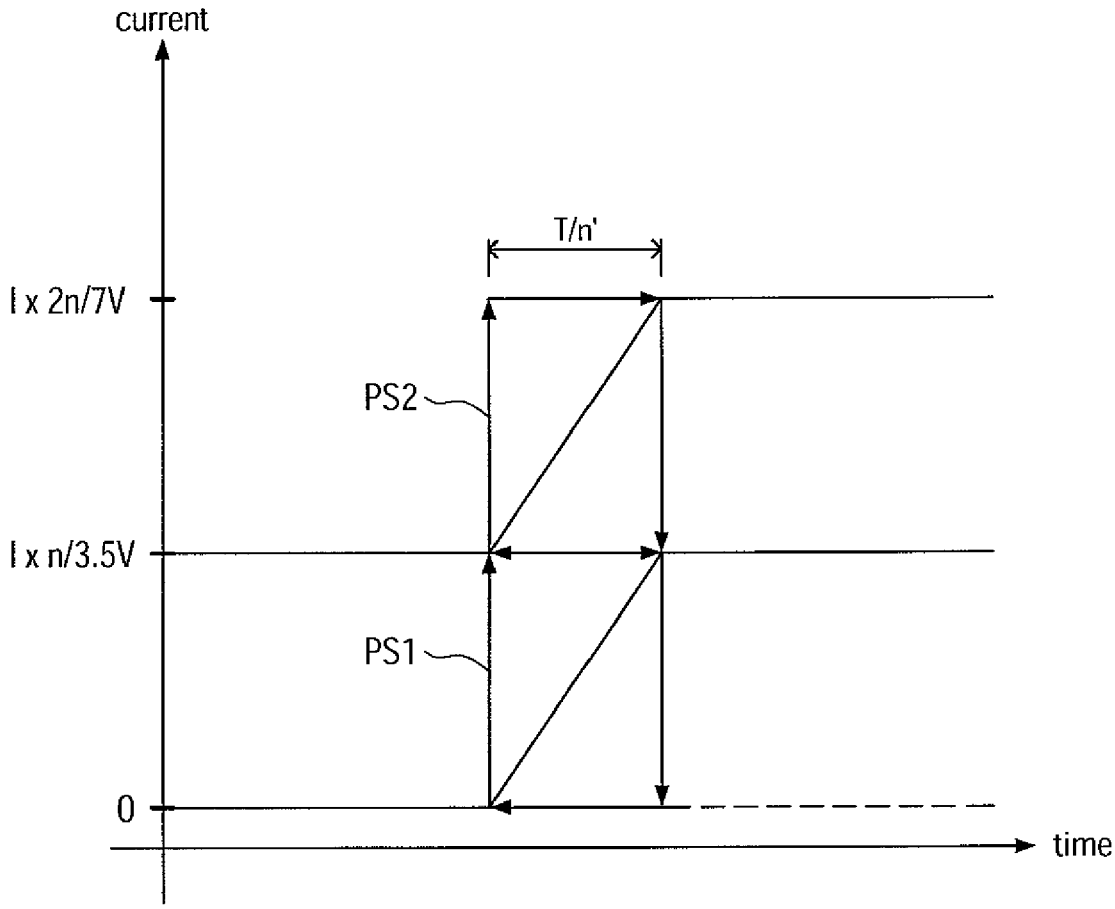
FIGS. 10-12 are plots of current as a function of time showing exemplary examples of waveform of driving pulse signals used in the method according to the present invention.

As described above, referring to FIG. 10, the LEDs are correspondingly driven by two identical driving pulse signals PS1, PS2 when the method of the present invention is used to drive two or more LEDs in series connection. Therefore, in comparison with FIG. 1, the light intensity will increase n×m times in the high voltage level duration (T/n'), wherein m is the number of LED and is 2 in the embodiment shown in FIG. 10.

Figure 5:
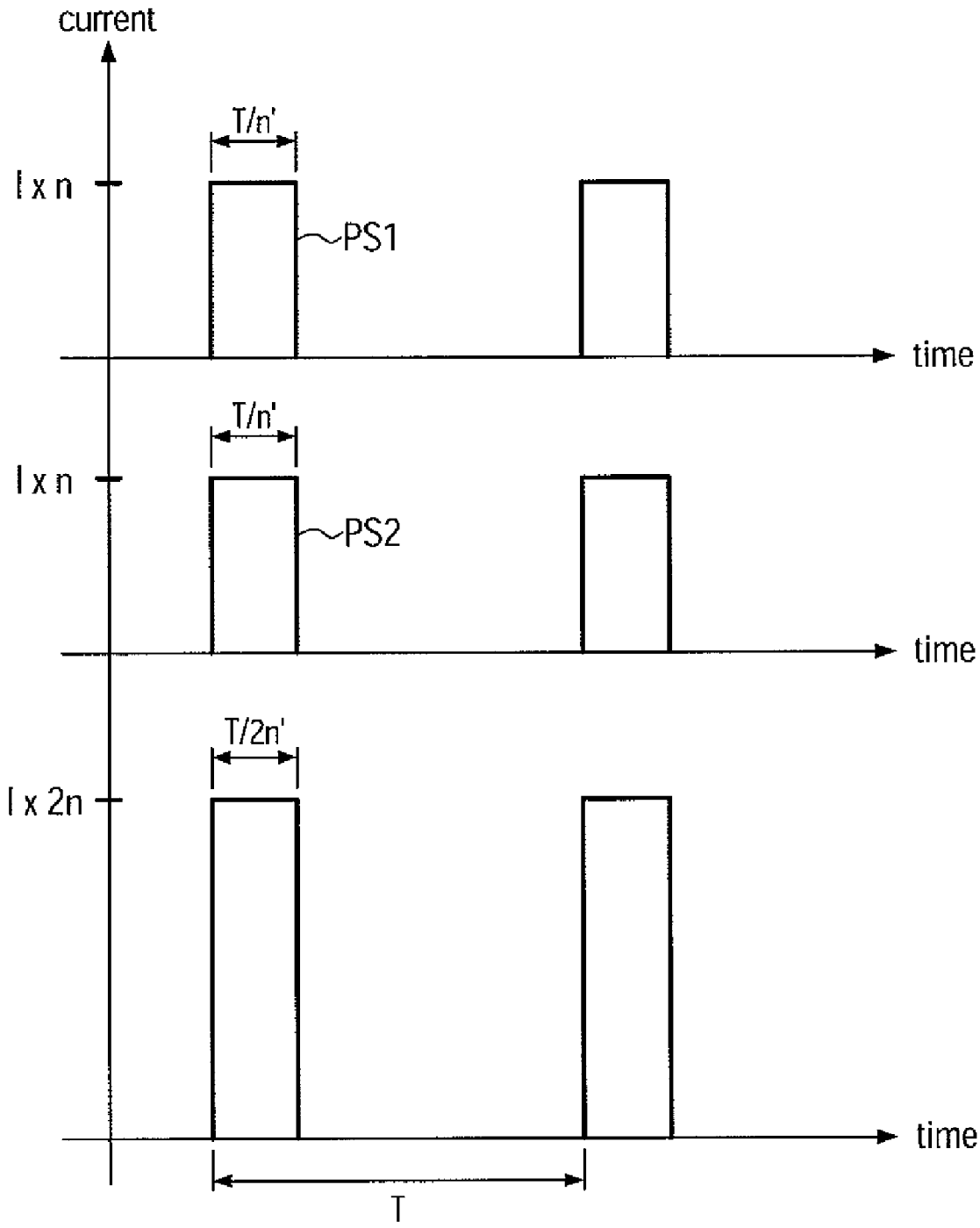
FIG. 5 is a plot of current as a function of time showing another exemplary example of a waveform of a driving pulse signal used in the method of driving a LED according to the present invention.
Figure 12:
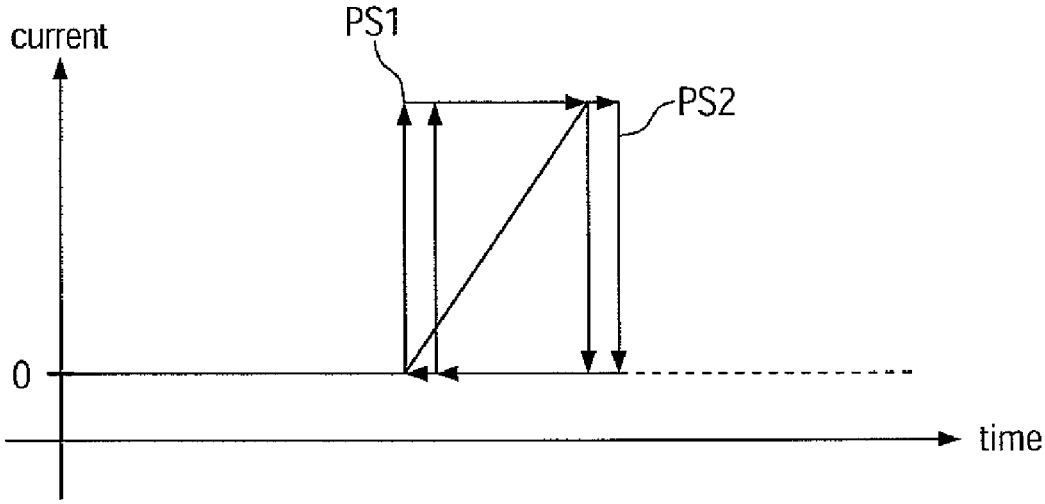

Referring now to FIGS. 5 and 12, the LEDs are correspondingly driven by two identical driving pulse signals PS1, PS2 when the method of the present invention is used to drive two or more LEDs in parallel connection. If the phases of the driving pulse signals PS1,PS2 are the same, that is, the driving pulse signals PS1,PS2 are synchronously provided to the corresponding LEDs, in comparison with FIG. 1, the light intensity will also increase n×m times in the high voltage level duration (T/n').

Figure 6:
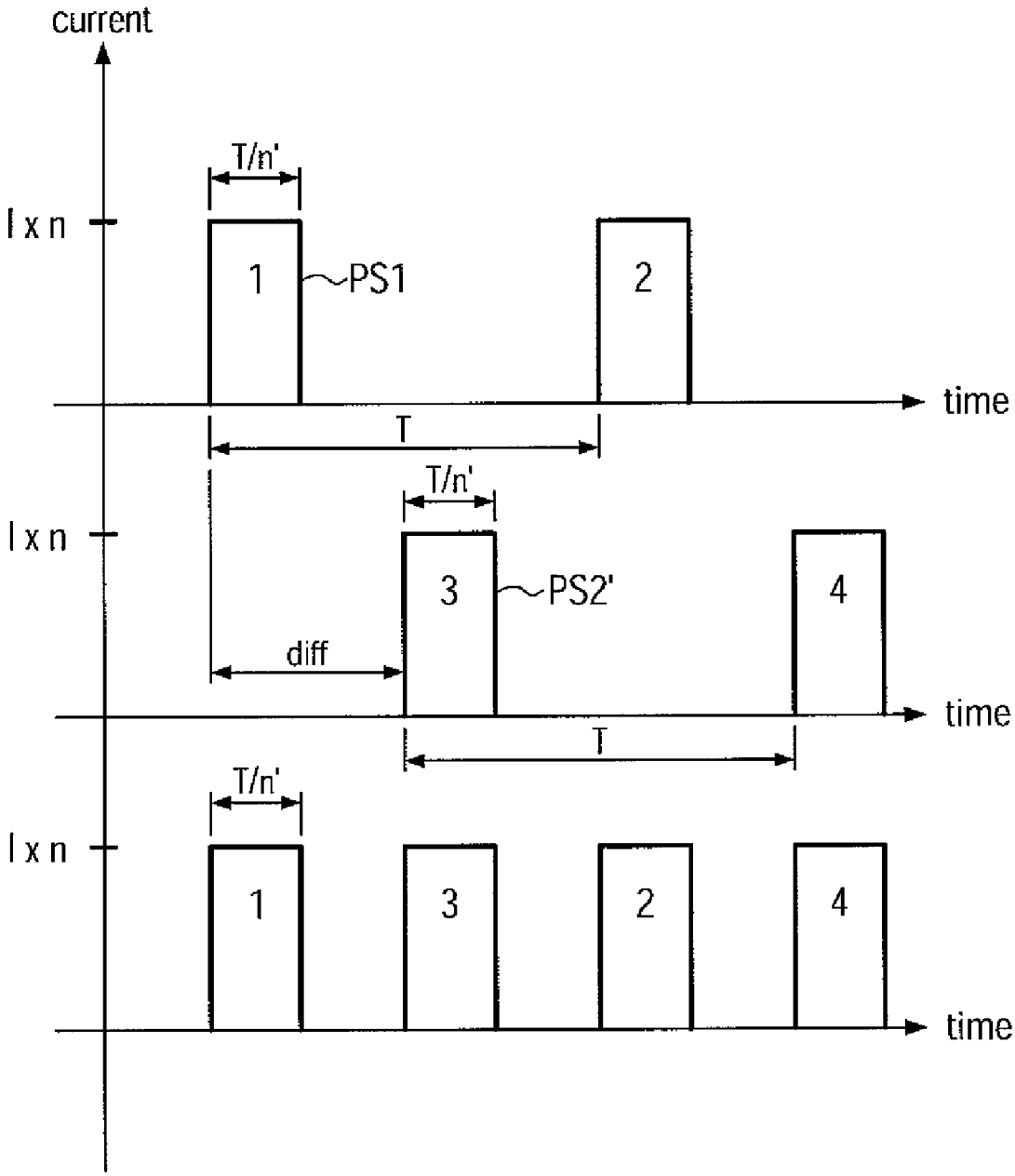
FIG. 6 is a plot of current as a function of time showing still another exemplary example of a waveform of a driving pulse signal used in the method of driving a LED according to the present invention.
Figure 11:
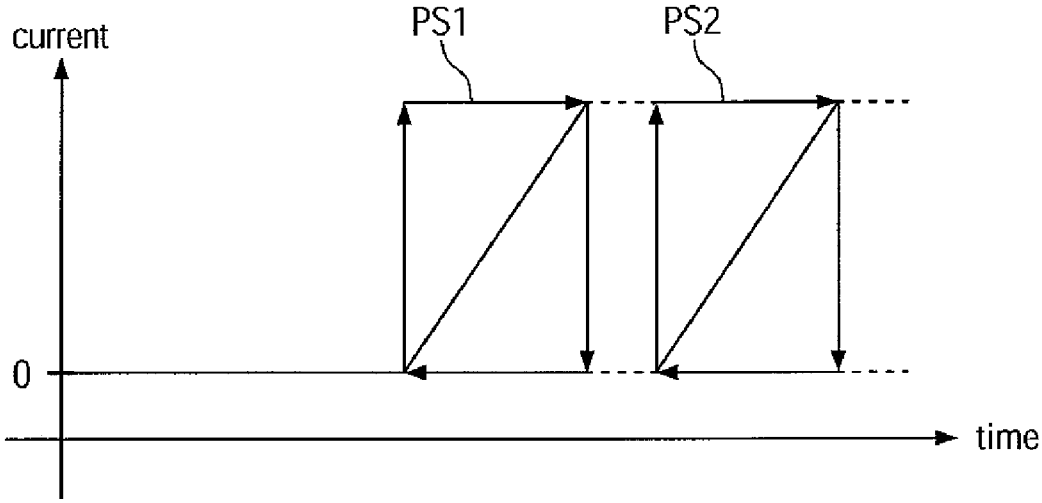

Referring now to FIGS. 6 and 11, the LEDs are correspondingly driven by two driving pulse signals PS1,PS2' having different phases. The phases of the driving pulse signals PS1, PS2 are different, but the peak value and the cycle time are the same. The phase difference diff between the driving pulse signals PS1 and PS2' can be selected depending on what is needed.

For n=4 and n'=8, the power consumption of PS1 during the high voltage level duration (T/n') is 1400 mA×3.5V≈4 W, the power consumption of PS2' during the high voltage level duration (T/n') is 1400 mA×3.5V≈4 W. Therefore, the power consumption of PS1 in a unit of time T is about 0.5 W, and the power consumption of PS2' is about 0.5 W. Therefore, two parallel-connected 1400 mA currents can increase 8 W slope and the light intensity, but the power consumption in a unit of time T is still about 1 W.

Figure 7:
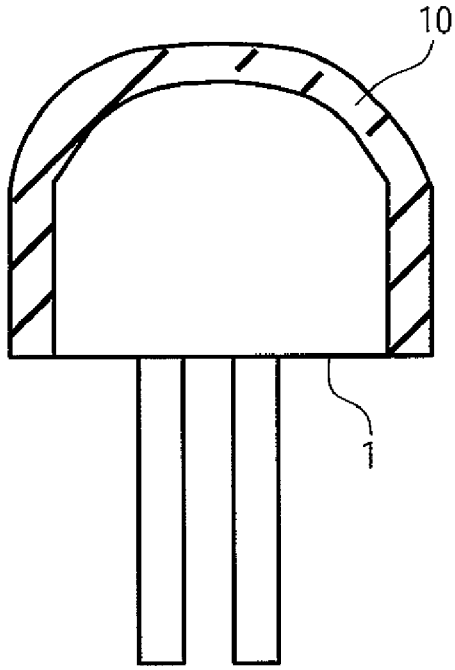
FIG. 7 is a schematic diagram of a LED which is coated with a photoluminescent material and which is driven by the method according to the present invention.
Figure 8:
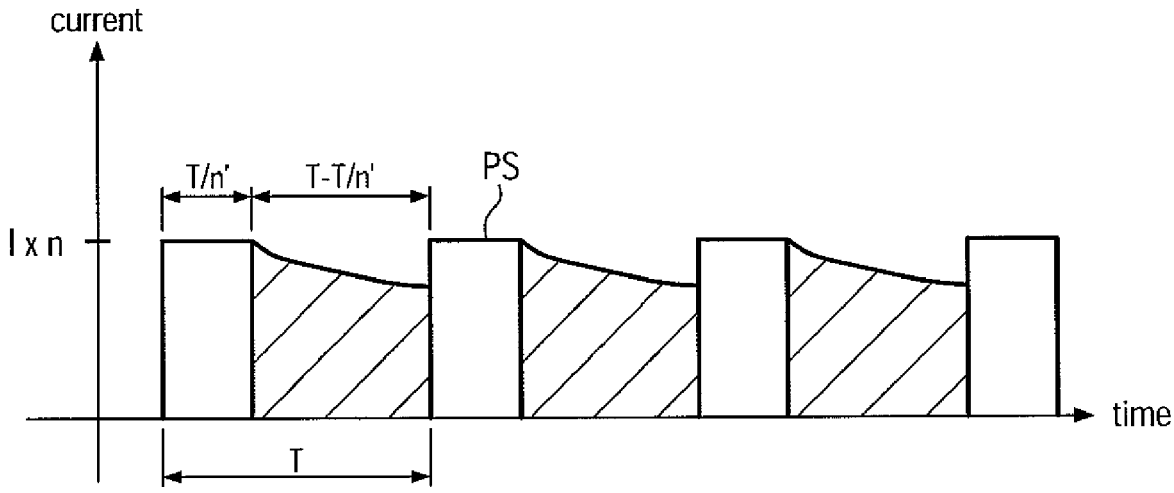
FIG. 8 is a schematic plot of current as a function of time for explaining the effect of the photoluminescent material coated on the LED shown in FIG. 7.
Figures 17, 18:
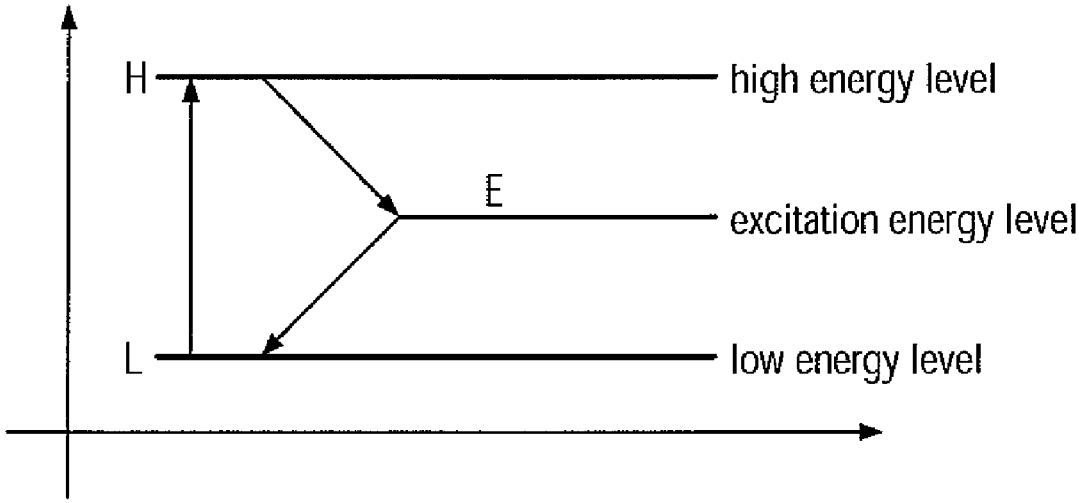
FIGS. 17-18 are schematic diagrams for explaining how flickering phenomenon is prevented from occurring by using the photoluminescent material coated on a LED when the LED is driven by the method according to the present invention.

Referring to FIGS. 7, 8, 17 and 18, in order to prevent flickering phenomenon from occurring at the time of (T−(T/4)), the cap surface of the LED is preferably coated with a photoluminescent material, such as phosphorescent or fluorescent material, which can absorb the ambient light and emit the absorbed light, such that the photoluminescent material will emit the light absorbed during the high voltage level duration (T/4) during the low voltage level duration (T−(T/4)). As shown in FIG. 8, the shadow portion is the low voltage level duration (T−(T/4)) during which the photoluminescent material release the stored photo energy. It should be noted that, the intensity of light emitted from the photoluminescent material is about 80% of that from the LED. As shown in FIG. 17, the low energy level L is a level corresponding to the low voltage level of the driving pulse signal, the high energy level H is a level corresponding to the high voltage level of the driving pulse signal, and the excitation energy level E is a level above which the LED emits light. A cycle from the low energy level to the high energy level, from the high energy level to the excitation energy level, and from the excitation energy level total takes 100 nsec. It should be noted that, when the driving pulse signal transits from the low voltage level to the high voltage level, the LED emits light, and the photoluminescent material on the LED absorbs and stores the photo energy from the emitted light. When the driving pulse signal transits from the high voltage level to the low voltage level, the LED will cease to emit light after down from the excitation energy level E to the low energy level L. In the meantime, the photoluminescent material will release the stored photo energy until the driving pulse signal transits from the low voltage level to the high voltage level. Therefore, in order to prevent flickering phenomenon from occurring at the time of (T−(T/4)), a condition that the duration during which the photoluminescent material coated on a LED releases stored photo energy is greater than the pulse cycle, and the pulse cycle is greater than 100 nsec., must be satisfy.

It should be noted that, the photoluminescent material may be doped with fluorescent powder or phosphorus powder. On the other hand, the LED shown in FIG. 7 is by way of example, the photoluminescent material may be coated on the lighting surface of any LED package.

Figure 13:
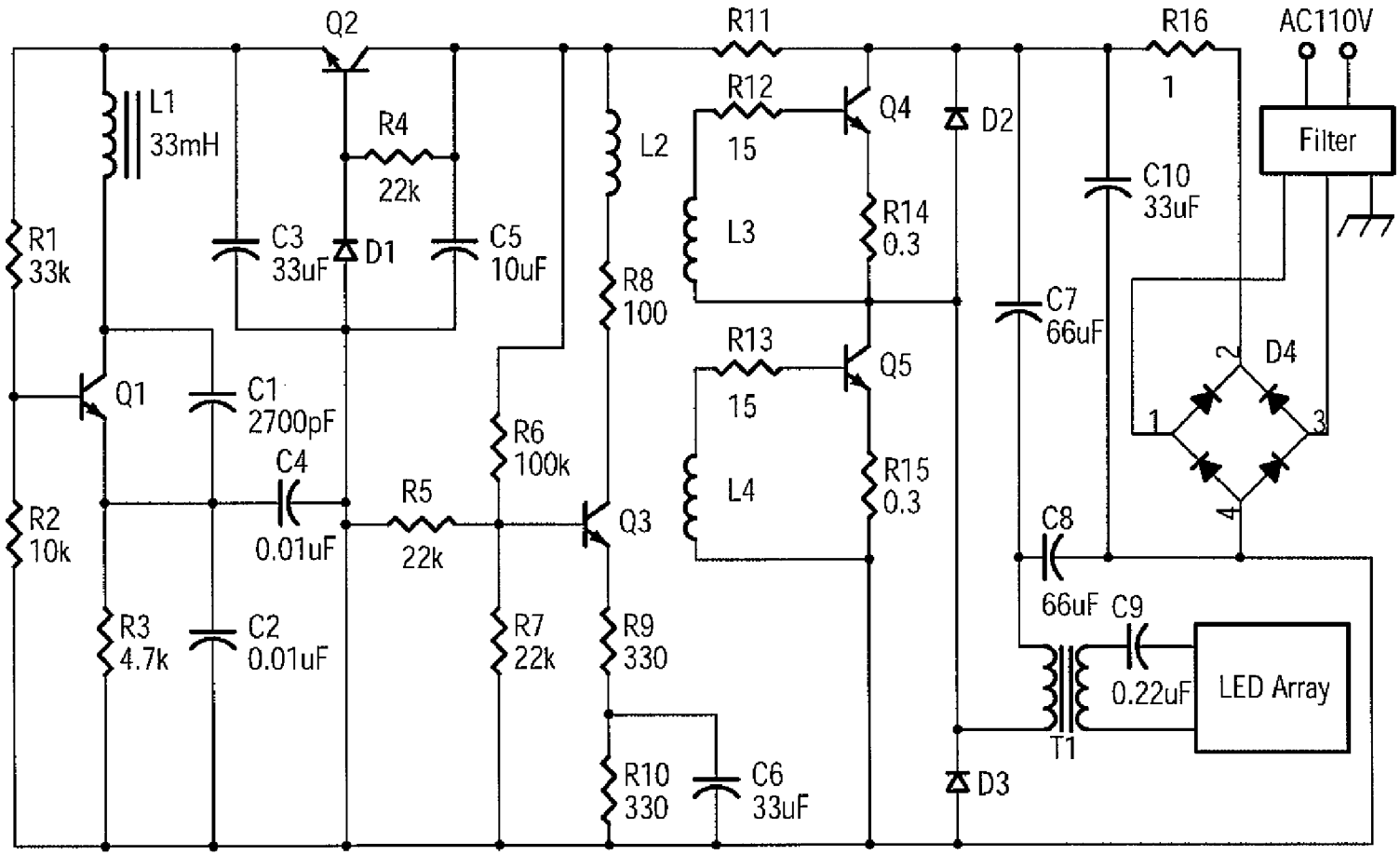
FIGS. 13-15 are circuit diagrams of the driving circuitries adapted to be used in the method according to the present invention.
Figure 14:
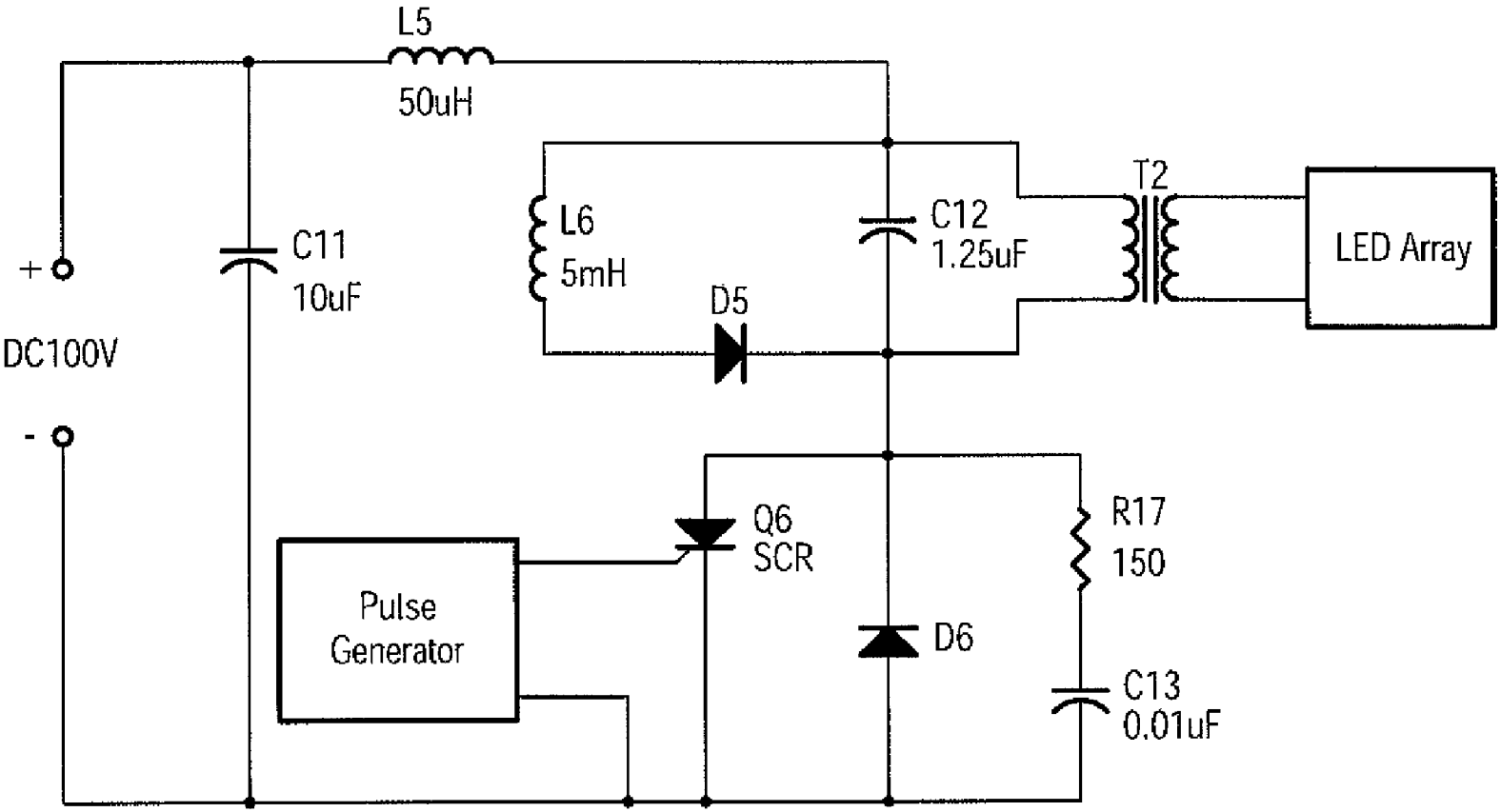
Figure 15:
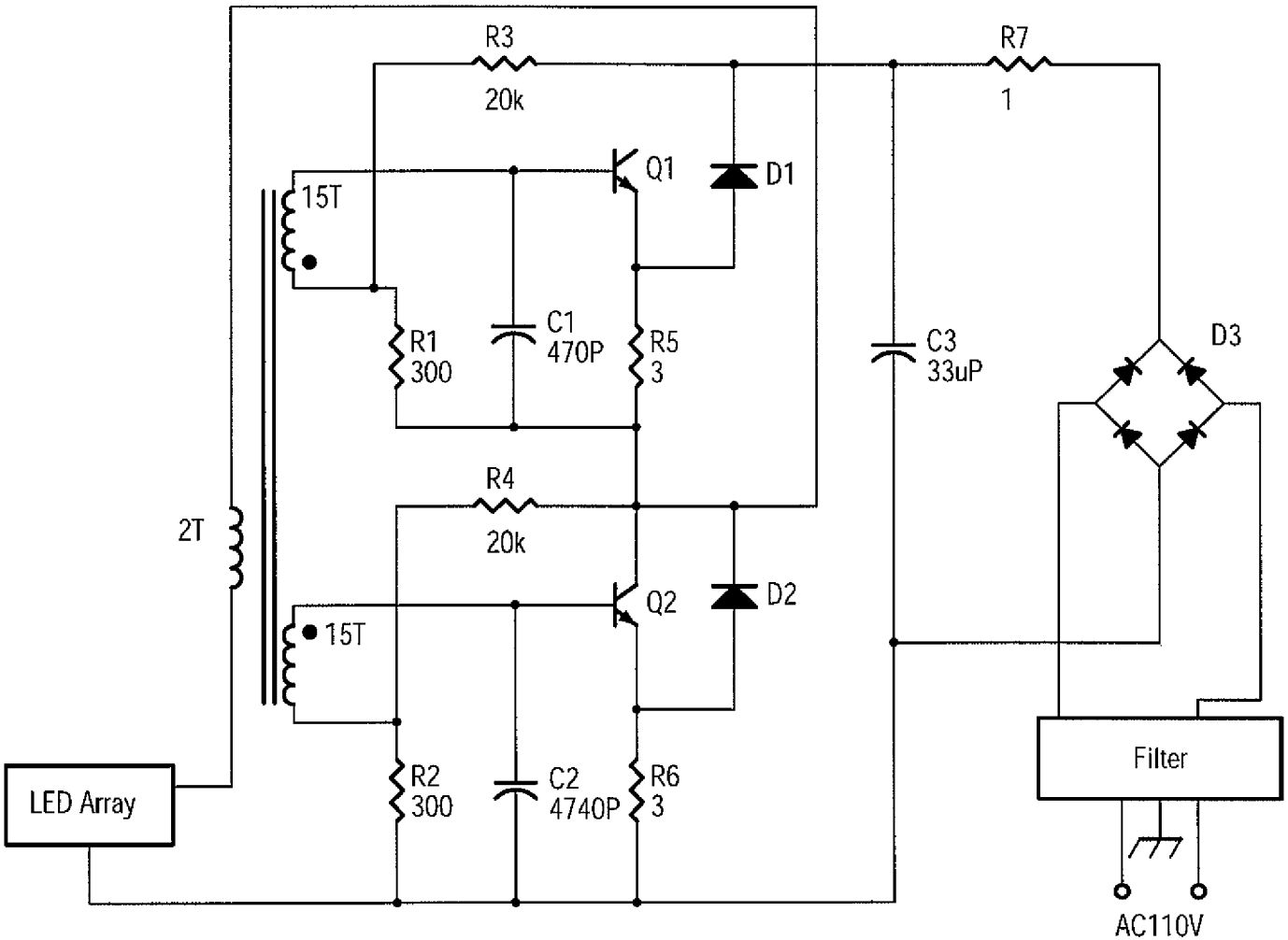
Figure 16:
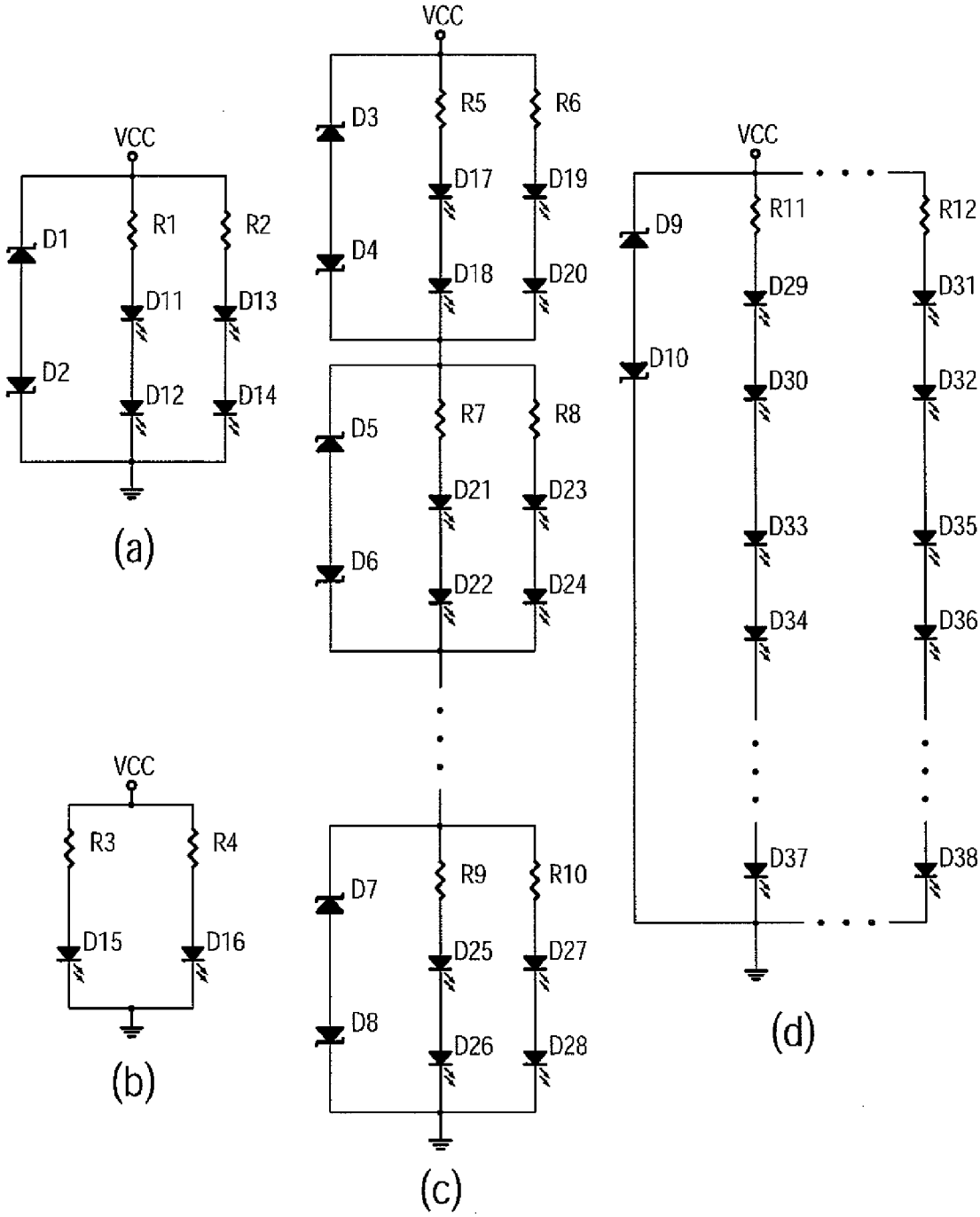
FIG. 16(*a*)-(*d*) are circuit diagrams showing various LED array examples adapted to be driven by the method according to the present invention.

FIGS. 13 to 15 are three LED driving circuitry examples that are adapted to be used in the present invention. FIG. 16 is a schematic diagram showing various LED array examples adapted to be driven by the method according to the present invention.

Additionally, in order to further prevent flickering phenomenon from occurring, the frequency of the driving pulse signal is set to 32 Hertz (Hz) or above.

The present examples and embodiments are to be considered as illustrative and not restrictive, and the invention is not to be limited to the details given herein, but may be modified within the scope and equivalence of the appended claims.

Furthermore, it should be apparent to those skilled in the art that a conventional RC circuitry can also be used to prevent flickering phenomenon from occurring, instead of the photoluminescent material.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for driving a light emitting diode (LED) which is driven by a pulse signal, wherein the pulse signal comprises pulses of a duration of T/n, wherein T is a duration of each of the pulses and a corresponding pause in between two consecutive pulses and n is at least 2, wherein a current value applied to the LED in each of the pulses is greater than double a maximum constant breakdown current of said LED.

2. A method according to claim 1, wherein n is at least 3 or at least 4.

3. A method according to claim 1, wherein the current of each of the pulses is at least n times the nominal constant current of said LED.

4. A method according to claim 1, wherein an electric power of at least 80%, or at least 100%, or at least 110% of the nominal power of said LED is applied to the LED.

5. A method according to claim 1, further comprising using a photoluminescent material coated lighting surface of said LED.

6. A method according to claim 5, wherein said photoluminescent material is doped with phosphor powder.

7. A method according to claim 5, wherein said photoluminescent material is doped with fluorescent powder.

8. A method according to claim 1, further comprising connecting multiple LEDs serially such that the light intensity of said LEDs will be increased by n×m times during the pulse duration time, wherein m is a number of said LEDs.

9. A method according to claim 1, further comprising connecting multiple LEDs in parallel, each of said LEDs driven by a same said current value, and said pulse signal received by each of said LEDs has a different phase.

10. A method according to claim 1, further comprising connecting LEDs in parallel, said pulse signal received by each of said LEDs has a same phase, such that during the pulse duration time, the light intensity of said LEDs will be increased by n×m times, wherein m is a number of said LEDs.

11. A method according to claim 1, wherein in the step of supplying driving pulse signal, said driving pulse signal has a frequency of at least 32 Hz.

12. A method according to claim 1, wherein the LED is cooled by means of a passive or an active cooling means.

13. An illumination system comprising:

at least one LED, and a driving circuit being electrically connected to said at least one LED to drive the LED with a pulse signal, wherein the pulse signal comprises current pulses of a duration of T/n, wherein T is a duration of each of the pulses and a corresponding pause in between two consecutive pulses and n is greater than 2, wherein the current pulses are applied with a current value more than double a maximum constant breakdown current of said LED to generate an increased light intensity of the LED.

14. A system according to claim 13, wherein n is at least 3 or at least 4.

15. A system according to claim 13, wherein the current of each pulse of the pulses is at least n times the nominal constant current of said LED.

16. A system according to claim 13, wherein an electric power of at least 80% of the nominal power of said LED is applied to the LED.

17. A system according to claim 13, further comprising a photoluminescent material coated lighting surface of said LED.

18. A system according to claim 17, wherein said photoluminescent material is doped with phosphor powder.

19. A system according to claim 17, wherein said photoluminescent material is doped with fluorescent powder.

20. A system according to claim 13, wherein in the driving circuit supplies a driving pulse signal, said driving pulse signal has a frequency of at least 32 Hz.

* * * * *